US005599036A

United States Patent [19]

Abondance et al.

[11] Patent Number: 5,599,036

[45] Date of Patent: Feb. 4, 1997

[54] SHAPED SKI OF NON-RECTANGULAR CROSS SECTION

[75] Inventors: Roger Abondance, La Murette; Jean Bauvois, Mas des Bernards; Laurent Boix Vives, Grenoble, all of France

[73] Assignee: Skis Rossignol S.A., Voiron, France

[21] Appl. No.: 958,676

[22] Filed: Oct. 9, 1992

[30] Foreign Application Priority Data

Nov. 19, 1991 [FR] France ..... 91 14749

[51] Int. Cl.[6] ..... A63C 5/07

[52] U.S. Cl. ..... 280/602; 280/610

[58] Field of Search ..... 280/601, 602, 280/610, 608, 609

[56] References Cited

U.S. PATENT DOCUMENTS

| | | | |
|---|---|---|---|
| 2,525,618 | 10/1950 | Pierce, Jr. | 280/610 |
| 3,416,810 | 12/1968 | Kennedy, III | 280/610 |
| 4,383,701 | 5/1983 | Hirnbock et al. | 280/610 |
| 4,671,529 | 6/1987 | LeGrand et al. . | |
| 5,002,300 | 3/1991 | Pascal et al. . | |
| 5,005,853 | 4/1991 | Lampl | 280/610 |

FOREIGN PATENT DOCUMENTS

| | | | |
|---|---|---|---|
| 0180678 | 5/1986 | European Pat. Off. . | |
| 0367964 | 5/1990 | European Pat. Off. . | |
| 0394835 | 10/1990 | European Pat. Off. . | |
| 2611518 | 9/1988 | France . | |
| 2611519 | 9/1988 | France . | |
| 2615404 | 11/1988 | France . | |
| 417430 | 2/1967 | Switzerland | 280/610 |
| 91/08029 | 6/1991 | WIPO . | |

OTHER PUBLICATIONS

Ski Magazine, Dec. 1986 pp. 116 & 117.

*Primary Examiner*—Robert J. Oberleitner
*Assistant Examiner*—Michael Mar
*Attorney, Agent, or Firm*—Oliff & Berridge

[57] ABSTRACT

A ski has a filling core, for example, polyurethane foam, a shell forming an upper face and lateral faces of the ski and a lower face including longitudinal metal edges and a central sliding sole. The ski has two longitudinal reinforcement elements which extend at least in the central part of the ski and are arranged on either side of the core. The two longitudinal reinforcement elements contact the core and at least part of the internal surface of the lateral faces of the ski. Each reinforcement element includes a lower face which extends mainly over a width of a corresponding edge to provide support, and extends over at least a part of a height of the ski.

19 Claims, 1 Drawing Sheet

SHAPED SKI OF NON-RECTANGULAR CROSS SECTION

BACKGROUND OF THE INVENTION

The present invention relates to a shaped ski of non-rectangular cross section.

It is more and more common to produce shaped skis, that is to say skis of non-rectangular cross section which have a shell forming the upper face and the lateral faces of the ski, these lateral faces possibly being inclined over at least a part of their height. In this case, this inclination can be constant or variable over the length of the ski, and can be brought about by plane or curved surfaces.

It is also advantageous to produce skis comprising a filling core made of synthetic foam material, for example of polyurethane, which has excellent properties of stability over time and is not of great weight.

The advantage of a conventional ski is in particular that it has rigid narrow sides, for example made of ABS or of phenolic laminate, which ensure excellent transmission of the forces exerted by the snow surface on the edges of the ski towards the upper face of the latter which is equipped with the binding for a boot of the skier.

DESCRIPTION OF THE PRIOR ART

Documents FR 2 611 519 and WO 91/08029 describe a ski with a shell, the lateral walls of which are inclined, comprising a core of rectangular cross section, and in which the transmission of the forces between the edges and the upper face is carried out by reinforcement elements situated in contact with the inclined walls and formed for example by sheets of fabric impregnated with resin. The space between the central core and the lateral faces is occupied by a filling material.

Documents FR 2 611 518, FR 2 615 404 and EP 0 394 835 relate to shaped skis, comprising a shell forming the inclined lateral faces of the ski, a core of rectangular cross section, reinforcement elements in contact with the inclined walls, with a space being arranged between the inclined walls and the core, which space is filled with viscoelastic elements which have a vibration-damping property.

The disadvantage of these different solutions derives from the fact that there are no wide elements which ensure direct transmission of the forces from the edges to the upper face which is equipped with the binding because the core is not supported on the edges and the elements for reinforcement of the shell are laid against the inclined sides of the latter and are supported at points on each edge.

The result therefore is skis which have average behavior characteristics and which cannot satisfy the required quality criteria, in particular in competition where the steering accuracy desired for the skis imposes as perfect as possible a transmission of the forces from the edges towards the upper face of the ski. Summary of the invention The aim of the invention is to provide a shaped ski of non-rectangular cross section, comprising a filling core, for example made of a synthetic foam material, and in particular of polyurethane, the upper face and the lateral faces of which are constituted by a shell, in order to have the quality of finish of skis comprising a shell while offering the technical qualities of conventional skis, ensuring at least in the central part direct transmission of the forces from the edges to the upper face of the ski which is equipped with the binding.

To this end, the ski according to the invention comprises two longitudinal reinforcement elements which extend at least in the central part of the ski and are arranged on either side of the core, in contact at the same time with the latter and the parts of the internal surface of the shell forming the lateral faces, each reinforcement element comprising a lower face which extends mainly over the width of the corresponding edge so as to afford it an effective support, and extends over at least a part of the height of the ski.

The longitudinal reinforcement elements ensure excellent support of the edge as well as the transmission of the forces received by each edge towards the upper face of the ski which is equipped with the binding. Each reinforcement element can extend practically over the entire height of the ski and serve as support on the one hand for an edge and on the other hand for the upper face of the ski, or extend on the contrary only over a part of the height of the ski and be associated with a reinforcement element which is in contact with the upper wall of the shell and absorbs the forces transmitted from the edge. This force-absorption element can for example be constituted by a fabric impregnated with resin.

Each reinforcement element can have a face situated on the side of the core, perpendicular to the plane of the sole or, on the contrary, inclined in relation to the perpendicular to the plane of the sole, have a constant width over the entire length of the ski, the core having a variable width, or, on the contrary, have a width which is variable along the ski, the core having in such a case a constant width.

Each reinforcement element can be made in a number of parts joined end to end in the longitudinal direction and made of materials having different characteristics, or even of a number of juxtaposed parts made of different materials.

In all cases, it is appropriate that in the central part of the ski; that is to say in the central part, the reinforcement elements are rigid, the ends of these same elements being capable of being more flexible and made for example of a viscoelastic material.

The rigid part of each reinforcement element can be made of a solid material, such as wood, a synthetic material or even made from fabric impregnated with resin and folded on itself, or even of a multi-material complex, such as Zicral-ABS, Zicral being a registered trade mark for an alloy of aluminum and ABS being acrylonitrile-butadiene styrene.

It is also possible to act on the characteristics and on the respective shapes of the two opposite reinforcement elements of one and the same ski in order to impart to this ski certain behavior characteristics. The two opposite reinforcement elements of one and the same ski can thus have different characteristics of rigidity and of damping, or have different geometric characteristics such as width and/or height.

Advantageously, the reinforcement elements extend over the entire active length of the ski, that is to say essentially between the front and rear contact zones of the ski on the snow, while the shell covers entirely the reinforcement elements.

According to another characteristic of the invention, a joint made of viscoelastic material is interposed locally in the end zones of the ski between the shell and the upper part of each reinforcement element, or between the shell and the edges.

Such a ski can be obtained with preliminary production of the core and assembly in the mold of the elements for reinforcement of the shell, or even by preassembly of the reinforcement elements with the shell before molding in situ of the core. It is also possible to extrude the reinforcement elements with the shell before molding of the core.

BRIEF DESCRIPTION OF THE DRAWINGS

In any case, the invention will be understood clearly with the aid of the following description, with reference to the attached diagrammatic drawings which show, byway of non-limiting example, a number of embodiments of this ski.

DESCRIPTION OF THE PREFERRED EMBODIMENTS

Figure 1:
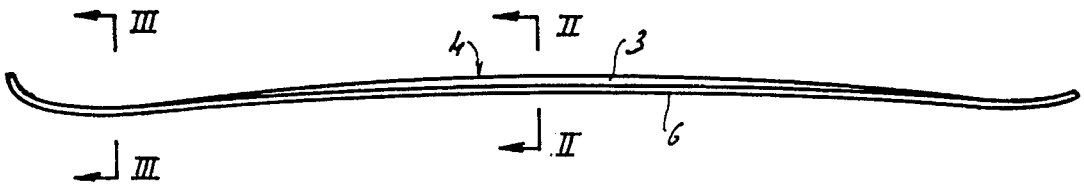
FIG. 1 is a side view of a ski according to the invention.
Figure 2:
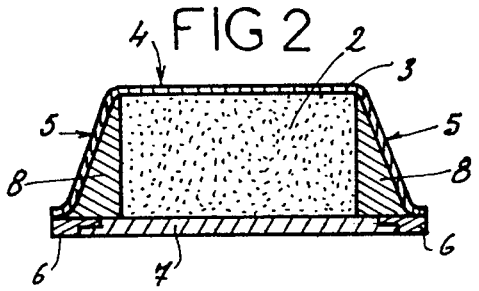
FIGS. 2 and 3 are two views thereof in transverse cross section and on an enlarged scale according to the lines II—II and III—III in FIG. 1 respectively.
Figure 3:
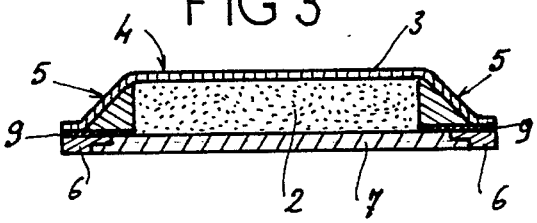

The ski shown in FIGS. 1 to 3 is a shaped ski of non-rectangular cross section, comprising a filling core 2, for example made of polyurethane foam, a shell 3 forming the upper face 4 of the ski and the two lateral faces 5 of the latter, longitudinal metal edges 6, and a sliding sole 7.

As shown in FIGS. 2 and 3, this ski comprises two longitudinal reinforcement elements 8 which extend at least in the central part of the runner of the ski and are arranged on either side of the core 2, between the latter and the inclined faces 5 of the shell 3. Each reinforcement element 8 comprises a lower face serving for support of an edge 6 so as to afford it effective support.

In the embodiment shown in FIGS. 1 to 3, each reinforcement element 8 extends practically over the entire height of the ski and serves for support of the upper face 4 of the shell. Moreover, each reinforcement element has a face, intended to be supported against the core, which is perpendicular to the plane of the sole. FIG. 3 shows the location between the sides of the shell 3 and the base of the reinforcement elements and the edges 6, in the end zones, of a layer of viscoelastic material 9.

Figure 4:
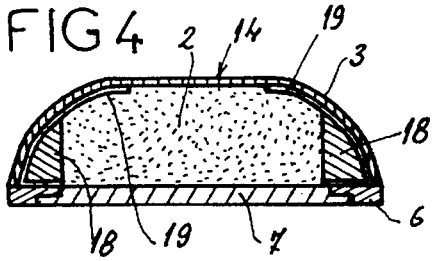
FIG. 4 is a view in transverse cross section and on an enlarged scale of an alternative embodiment of this ski.

FIG. 4 shows an alternative embodiment of the ski in FIGS. 1 to 3, in which each reinforcement element 18 extends over only a part of the height of the ski and is integral with a reinforcement element 19 constituted for example by a fabric impregnated with resin which is itself in contact with the upper face 14 of the shell and which is intended to transmit to the latter the forces to which the edges 16 are subjected.

Figure 5:
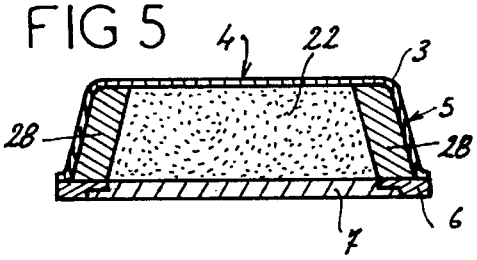
FIG. 5 is a view in transverse cross section and on enlarged scale of another alternative embodiment of this ski.

FIG. 5 shows another embodiment of this ski, in which each reinforcement element 28 has a face intended to be supported against the core 22, which face is inclined in relation to the perpendicular to the plane of the sole.

Figure 6:
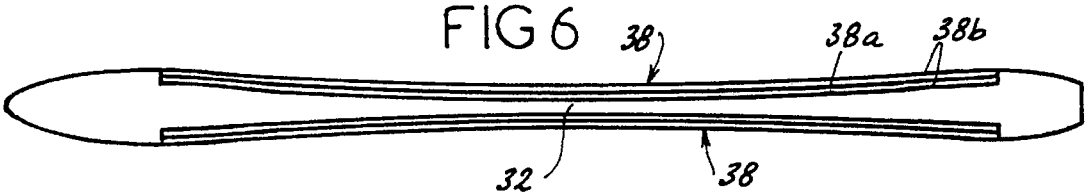
FIGS. 6 and 7 are two views from above of a ski without the shell, showing two possibilities for production of the reinforcement elements.

FIG. 6 shows a ski, without the shell, in a view from above, in which each reinforcement element, designated by the general reference 38, has a constant base width over its entire length, the core 32 having for its part a variable width in order to take account of the dimension lines of the ski. Moreover, in this embodiment, each reinforcement element is constituted by a multi-material complex comprising at least two different materials, for example a central layer of Zicral 38*a* and two lateral layers of ABS 38*b*.

Figure 7:
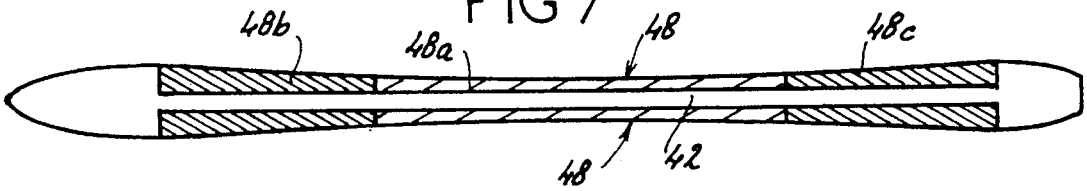

FIG. 7 shows another embodiment, in which each reinforcement element 48 has a base width which is variable along the ski over its entire length, while the core 42 for its part has a width which is constant along the ski. Moreover, and to illustrate another possibility of the invention, each reinforcement element comprises a central part 48*a* which extends at least in the runner zone of the ski and is made of a rigid material, and two end zones, front 48*b* and rear 48*c* respectively, which are joined end to end longitudinally to the zone 48*a* and which are made of a material having different characteristics, for example of a viscoelastic material. Such a combination is of interest to the extent that it is necessary to have excellent support in the region of the runner, which is brought about by the rigid element 48*a*, and that it is advantageous to obtain good damping in the region of the ends, which is obtained by virtue of the viscoelastic elements 48*b* and 48*c*.

As emerges from the above, the invention brings a great improvement to the existing art by providing a shaped ski of non-rectangular cross section which has the qualities of presentation of skis with a shell, while having the technical behavior characteristics of conventional skis.

It goes without saying that the invention is not limited to the embodiments of this ski alone which are described above by way of example, but on the contrary it includes all alternative embodiments.

Thus, in particular, the reinforcement elements could be monolithic, or the reinforcement elements could extend only in the central part alone of the ski, or certain of the characteristics, described with reference to one embodiment, could be combined with characteristics described with reference to another embodiment without in so doing departing from the scope of the invention.

We claim:

1. A shaped ski of nonrectangular cross section, comprising:

an integral core formed of a foamed filling material and extending along a substantial part of a longitudinal length of the ski, a unitary outer shell forming an upper wall and lateral walls of the ski, the lateral walls having a greater separation as they extend downwardly from the upper wall, a lower wall with longitudinal edge members and with a central sliding sole, the upper and lower walls being in contact with the core, longitudinal reinforcement elements extending along a substantial length of the ski, each reinforcement element including a central portion and end portions, and being arranged on either side of the core, each reinforcement element being in contact at the same time with the core and an inner surface of one of the lateral walls, each reinforcement element comprising a lower surface which extends over a substantial portion of a transverse width of the corresponding edge member, and each reinforcement element extending over at least a part of a height of the ski, wherein each reinforcement element has a tapered width that reduces in an upwardly direction and is within an area between the one of the lateral walls and a plane extending transverse to the lower wall, the plane extending substantially from where the upper wall and the one of the lateral walls join downwardly to the lower wall, a width of the lower surface of each reinforcement element being constant over the longitudinal length of the reinforcement element and a width of the core being variable over the longitudinal length of the core, each reinforcement element being made of a rigid material at least along its central portion and the rigidity of the reinforcement element at least along its central portion being greater than the rigidity of the core.

2. The ski as claimed in claim 1, wherein each reinforcement element extends over substantially an entire height of the ski and serves for support of the upper wall of the unitary outer shell.

3. The ski as claimed in claim 1, wherein each reinforcement element extends over only a part of the height of the ski and is integral with a reinforcement element in contact with the upper wall of the unitary outer shell.

4. The ski as claimed in claim 1, wherein each reinforcement element has an inner surface supported against the core, which is perpendicular to a plane of the lower wall.

5. The ski as claimed in claim 1, wherein each reinforcement element comprises a number of parts which are joined end to end in a longitudinal direction of the ski and are made of materials having different characteristics.

6. The ski as claimed in claim 1, wherein each reinforcement element comprises a number of juxtaposed parts made of materials having different characteristics.

7. The ski as claimed in claim 1, wherein the central portion of each reinforcement element is the rigid material and two end portions are made of a viscoelastic material.

8. The ski as claimed in claim 1, wherein at least the central portion of each reinforcement element comprises a rigid central part made from fabric impregnated with resin and folded on itself.

9. The ski as claimed in claim 1, wherein the reinforcement elements have different characteristics of rigidity and damping.

10. The ski as claimed in claim 1, wherein the reinforcement elements extend essentially between front and rear contact zones of the ski on the snow, while the shell covers the reinforcement elements.

11. The ski as claimed in claim 1, wherein a joint made of viscoelastic material is interposed locally in end zones of the ski between the shell and an upper part of each reinforcement element.

12. The ski as claimed in claim 1, wherein the core is made independently, then assembled with the reinforcement elements and with the unitary outer shell.

13. The ski as claimed in claim 1, wherein the reinforcement elements are first assembled with the unitary outer shell or extruded with the unitary outer shell, after which the core is injected in situ.

14. The ski as claimed in claim 1, wherein the core comprises polyurethane foam.

15. The ski as claimed in claim 1, wherein the longitudinal edge members are metal.

16. The ski as claimed in claim 1, wherein at least the central portion of each reinforcement element is made from a multi-material complex.

17. The ski as claimed in claim 16, wherein the multi-material complex comprises an alloy of aluminum and acrylonitrile-butadiene styrene.

18. The ski as claimed in claim 1, wherein the two opposite reinforcement elements of one and the same ski have different geometric characteristics.

19. The ski as claimed in claim 18, wherein said geometric characteristics include at least one of width and height.

* * * * *